US009264173B2

(12) United States Patent
Delaveau et al.

(10) Patent No.: US 9,264,173 B2
(45) Date of Patent: Feb. 16, 2016

(54) METHOD FOR JAMMING COMMUNICATIONS IN AN OPEN-LOOP-CONTROLLED NETWORK

(71) Applicant: THALES, Neuilly-sur-Seine (FR)

(72) Inventors: François Delaveau, Gennevilliers (FR); Dominique Heurguier, Gennevilliers (FR)

(73) Assignee: THALES, Courbevoie (FR)

( * ) Notice: Subject to any disclaimer, the term of this patent is extended or adjusted under 35 U.S.C. 154(b) by 150 days.

(21) Appl. No.: 14/109,838

(22) Filed: Dec. 17, 2013

(65) Prior Publication Data

US 2014/0170963 A1 Jun. 19, 2014

(30) Foreign Application Priority Data

Dec. 19, 2012 (FR) ..... 12 03479

(51) Int. Cl.
*H04K 3/00* (2006.01)

(52) U.S. Cl.
CPC .. *H04K 3/40* (2013.01); *H04K 3/28* (2013.01); *H04K 3/94* (2013.01); *H04K 3/42* (2013.01); *H04K 2203/34* (2013.01); *H04K 2203/36* (2013.01)

(58) Field of Classification Search
CPC ..... H04K 3/42; H04K 3/28; H04K 2203/34; H04K 3/228; H04K 2203/32; H04K 2203/18; H04K 3/00
USPC ..... 455/1, 500, 517, 445, 422.1, 403, 522, 455/69, 68, 509, 515, 404.1, 404.2, 458; 342/14, 16, 17; 370/310, 328, 329, 343
See application file for complete search history.

(56) References Cited

U.S. PATENT DOCUMENTS

| | | | | |
|---|---|---|---|---|
| 4,578,817 | A | 3/1986 | Rabain et al. | |
| 2002/0114269 | A1 | 8/2002 | Onggosanusi et al. | |
| 2010/0289688 | A1 * | 11/2010 | Sherman et al. | 342/16 |
| 2013/0178148 | A1 | 7/2013 | Delaveau et al. | |

FOREIGN PATENT DOCUMENTS

| | | | |
|---|---|---|---|
| EP | 1 471 650 | A2 | 10/2004 |
| FR | 2983373 | A1 | 5/2013 |
| WO | 98/34412 | A2 | 8/1998 |
| WO | 2007/086790 | A1 | 8/2007 |

* cited by examiner

*Primary Examiner* — Keith Ferguson
(74) *Attorney, Agent, or Firm* — Baker & Hostetler LLP

(57) ABSTRACT

A method for optimizing the jamming of P predefined zones or positions in a communications network of transmitters, jammers and receivers comprising several platforms, uses a local reception situation at the level of each friendly platform, a local jamming situation at the level of each friendly reception platform, and determines for each friendly transmitting platform and each friendly receiving platform, one or more parameters so as to minimize or to eliminate the fratricidal effects on the friendly reception platforms.

11 Claims, 5 Drawing Sheets

Transmission network $$S(t)=\begin{pmatrix} S_1(t) \\ \\ S_M(t) \end{pmatrix}$$

Reception network $$X(t)=\begin{pmatrix} X_1(t) \\ \\ X_N(t) \end{pmatrix}$$

Channel filtering matrix $$=\begin{pmatrix} H_{11}(t) & & H_{1M}(t) \\ & & \\ H_{N1}(t) & & H_{NM}(t) \end{pmatrix}$$

Spatial and convolutional mixutre of the input S by the channel filter to produce the output X $$X(t)=(H*S)(t) \rightarrow \begin{pmatrix} X_1(t) \\ \\ X_N(t) \end{pmatrix}=\left[\begin{pmatrix} H_{11} & & H_{1M} \\ & & \\ H_{N1} & & H_{NM} \end{pmatrix}*\begin{pmatrix} S_1 \\ \\ S_M \end{pmatrix}\right](t)$$

Temporal convolutional mixture between elements n and m of the transmisssion/reception networks $$X_{nm}(t)=(H_{mn}*S_m)(t)$$

$$=\sum_{l=1}^{L_{mn}}\alpha_l^{(m,n)}\left[\sum_{n_l=1}^{N_l}\alpha_{(n_l,l)}^{(m,n)}\exp\left[j\left((2\pi v/\lambda)\cos\theta_{(n_l,l)}^{(m,n)}-\gamma_l^{(m,n)}\right)t+\varphi_{(n_l,l)}^{(m,n)}\right]\right]U_\Theta\left(\theta_{(n_l,l)}^{(m,n)}\right)S_m\left(t-\tau_l^{(m,n)}\right)$$

Spatial-temporal convolutional mixture between element n and signal vector transmitted $S(t)=\begin{pmatrix} S_1(t) \\ \\ S_M(t) \end{pmatrix}$ $$X_n(t)=\sum_{m=1}^{M}X_{mn}(t)=\sum_{m=1}^{M}(H_{mn}*S_m)(t)$$

FIG.2

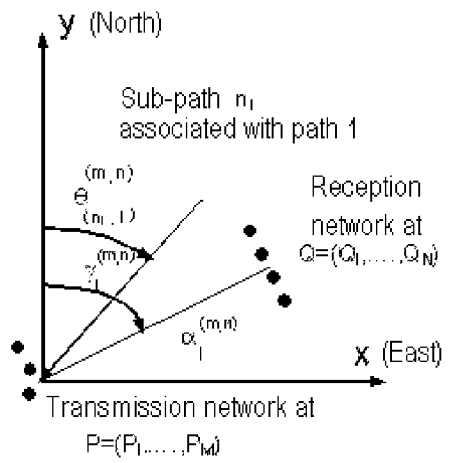

SET OF PLATFORMS TO SET OF PLATFORMS

ORIENTED NETWORK GRAPH AND GRAPH MATRIX G: SISO links G' = G

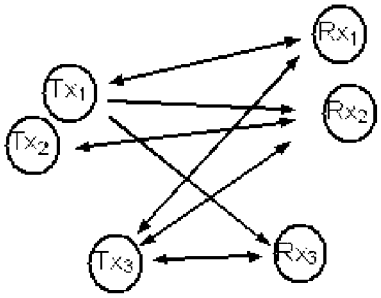

$$G'^{(A)}_{Tx\to Rx} = G^{(A)}_{Tx\to Rx} = \begin{pmatrix} 1 & 1 & 1 \\ 0 & 1 & 0 \\ 1 & 1 & 1 \end{pmatrix} \quad G'^{(R)}_{Rx\to Tx} = G^{(R)}_{Rx\to Tx} = \begin{pmatrix} 1 & 0 & 1 \\ 0 & 1 & 1 \\ 0 & 0 & 1 \end{pmatrix}$$

$$G'_{Tx\to Rx} = G_{Tx\to Rx} = \begin{pmatrix} \begin{pmatrix} 0 & 0 & 0 \\ 0 & 0 & 0 \\ 0 & 0 & 0 \end{pmatrix} & \begin{pmatrix} 1 & 1 & 1 \\ 0 & 1 & 0 \\ 1 & 1 & 1 \end{pmatrix} \\ \begin{pmatrix} 1 & 0 & 1 \\ 0 & 1 & 1 \\ 0 & 0 & 1 \end{pmatrix} & \begin{pmatrix} 0 & 0 & 0 \\ 0 & 0 & 0 \\ 0 & 0 & 0 \end{pmatrix} \end{pmatrix}$$

SAME TOPOLOGY WITH MIMO LINKS 2×2 ORIENTED NETWORK MACROGRAPH AND MACROGRAPH MATRIX G'

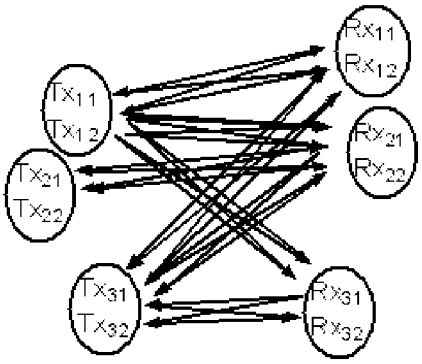

$$G'^{(A)}_{Tx\to Rx} = \begin{pmatrix} \begin{pmatrix} 1 & 1 \\ 1 & 1 \end{pmatrix} & \begin{pmatrix} 1 & 1 \\ 1 & 1 \end{pmatrix} & \begin{pmatrix} 1 & 1 \\ 1 & 1 \end{pmatrix} \\ \begin{pmatrix} 0 & 0 \\ 0 & 0 \end{pmatrix} & \begin{pmatrix} 1 & 1 \\ 1 & 1 \end{pmatrix} & \begin{pmatrix} 0 & 0 \\ 0 & 0 \end{pmatrix} \\ \begin{pmatrix} 1 & 1 \\ 1 & 1 \end{pmatrix} & \begin{pmatrix} 1 & 1 \\ 1 & 1 \end{pmatrix} & \begin{pmatrix} 1 & 1 \\ 1 & 1 \end{pmatrix} \end{pmatrix} \quad G'^{(R)}_{Rx\to Tx} = \begin{pmatrix} \begin{pmatrix} 1 & 1 \\ 1 & 1 \end{pmatrix} & \begin{pmatrix} 0 & 0 \\ 0 & 0 \end{pmatrix} & \begin{pmatrix} 1 & 1 \\ 1 & 1 \end{pmatrix} \\ \begin{pmatrix} 0 & 0 \\ 0 & 0 \end{pmatrix} & \begin{pmatrix} 1 & 1 \\ 1 & 1 \end{pmatrix} & \begin{pmatrix} 0 & 0 \\ 0 & 0 \end{pmatrix} \\ \begin{pmatrix} 0 & 0 \\ 0 & 0 \end{pmatrix} & \begin{pmatrix} 0 & 0 \\ 0 & 0 \end{pmatrix} & \begin{pmatrix} 1 & 1 \\ 1 & 1 \end{pmatrix} \end{pmatrix}$$

$$G'_{\substack{MIMO\ Duplex \\ Tx\to Rx}} = \begin{pmatrix} \begin{pmatrix} 0 & 0 & 0 & 0 & 0 & 0 \\ 0 & 0 & 0 & 0 & 0 & 0 \\ 0 & 0 & 0 & 0 & 0 & 0 \\ 0 & 0 & 0 & 0 & 0 & 0 \\ 0 & 0 & 0 & 0 & 0 & 0 \\ 0 & 0 & 0 & 0 & 0 & 0 \end{pmatrix} & \begin{pmatrix} 1 & 1 & 0 & 0 & 1 & 1 \\ 1 & 1 & 0 & 0 & 0 & 0 \\ 0 & 0 & 1 & 1 & 0 & 0 \\ 0 & 0 & 1 & 1 & 0 & 0 \\ 1 & 1 & 1 & 1 & 1 & 1 \\ 1 & 1 & 1 & 1 & 1 & 1 \end{pmatrix} \\ \begin{pmatrix} 1 & 1 & 0 & 0 & 1 & 1 \\ 1 & 1 & 0 & 0 & 0 & 0 \\ 0 & 0 & 1 & 1 & 1 & 1 \\ 0 & 0 & 1 & 1 & 1 & 1 \\ 0 & 0 & 0 & 0 & 1 & 1 \\ 0 & 0 & 0 & 0 & 1 & 1 \end{pmatrix} & \begin{pmatrix} 0 & 0 & 0 & 0 & 0 & 0 \\ 0 & 0 & 0 & 0 & 0 & 0 \\ 0 & 0 & 0 & 0 & 0 & 0 \\ 0 & 0 & 0 & 0 & 0 & 0 \\ 0 & 0 & 0 & 0 & 0 & 0 \\ 0 & 0 & 0 & 0 & 0 & 0 \end{pmatrix} \end{pmatrix}$$

SAME NETWORK TOPOLOGY WITH MIMO LINKS
OF IDENTICAL SIZE K×K' (TRANSMITTERS×RECEIVERS),

Direction Tx → Rx : PROPAGATION MATRICES $G^{(A)}_{mn}$ m=1…M, n=1…N, size K×K'

Direction Rx → Tx : PROPAGATION MATRICES $G^{(R)}_{mn}$ m=1…M, n=1…N, size K'×K

⇒ DETERMINE THE ORIENTED MACRO-GRAPH MATRIX G'

$G'_{MIMO\ Duplex}$
$Tx_1,\ldots,Tx_M \to Rx_1,\ldots,Rx_N$
$\sum_{m=1}^{M} K_m$ elts $\to \sum_{n=1}^{N} K'_n$ elts
Simplified case $K_m = K_n = K$
$K'_n = K'_m = K'$ $MK_m$ elts $\to NK'_n$ elt $$\underset{Tx\to Rx}{=} \begin{pmatrix} \begin{pmatrix} [0]_{(K\times K')} & [0]_{(K\times K')} & \cdots & [0]_{(K\times K')} \\ [0]_{(K\times K')} & [0]_{(K\times K')} & & [0]_{(K\times K')} \\ \cdots & \cdots & \cdots & \cdots \\ [0]_{(K\times K')} & [0]_{(K\times K')} & \cdots & [0]_{(K\times K')} \end{pmatrix} & \begin{pmatrix} [G'^{A}_{11}] & [G'^{A}_{12}] & \cdots & [G'^{A}_{1N}] \\ [0]_{(K\times K')} & [G'^{A}_{22}] & \cdots & [0]_{(K\times K')} \\ \cdots & \cdots & \cdots & \cdots \\ [G'^{A}_{M1}] & [G'^{A}_{M2}] & \cdots & [G'^{A}_{MN}] \end{pmatrix} \\ \begin{pmatrix} [G'^{R}_{11}] & [0]_{(K'\times K)} & \cdots & [G'^{R}_{M1}] \\ [G'^{R}_{12}] & [G'^{R}_{22}] & \cdots & [G'^{R}_{M2}] \\ \cdots & \cdots & \cdots & \cdots \\ [0]_{(K'\times K)} & [0]_{(K'\times K)} & \cdots & [G'^{R}_{MN}] \end{pmatrix} & \begin{pmatrix} [0]_{(K'\times K)} & [0]_{(K'\times K)} & \cdots & [0]_{(K'\times K)} \\ [0]_{(K'\times K)} & [0]_{(K'\times K)} & \cdots & [0]_{(K'\times K)} \\ \cdots & \cdots & \cdots & \cdots \\ [0]_{(K'\times K)} & [0]_{(K'\times K)} & \cdots & [0]_{(K'\times K)} \end{pmatrix} \end{pmatrix}$$

FIG.3A

OTHER EXAMPLE OF ORIENTED NETWORK GRAPH WITH SISO LINKS
GRAPH MATRIX G AND MACROGRAPH MATRIX G' (G' = G)
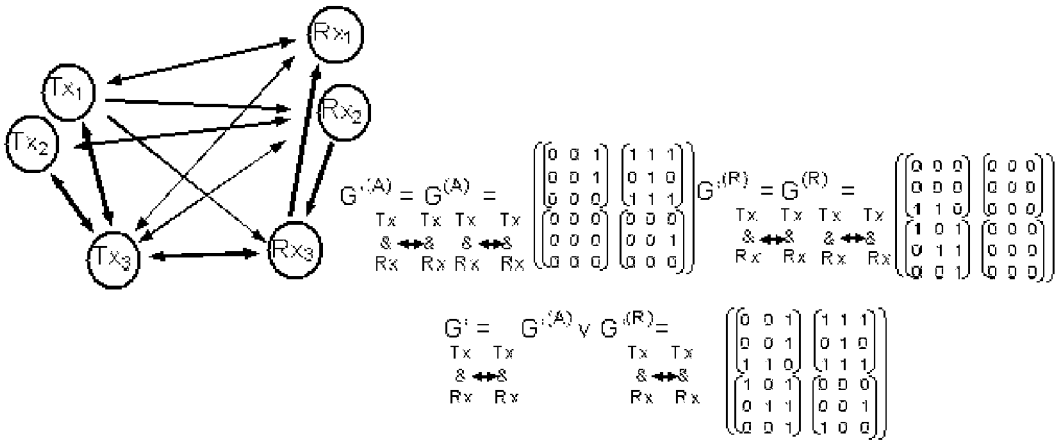
SAME TOPOLOGY WITH 2×2 MINO LINKS
ORIENTED NETWORK MACROGRAPH G' AND MACROGRAPH MATRIX
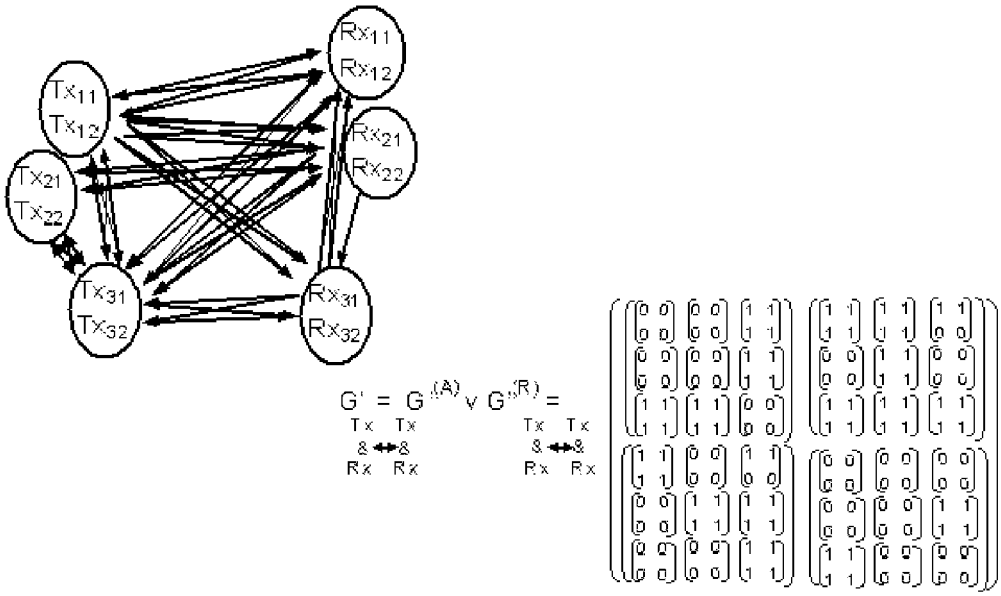
FIG.3B

DEFINITION OF THE TERM-BY-TERM LOGICAL PRODUCT GENERAL CASE

A and B matrices of the same size N×M.

$$A=\begin{pmatrix} A_{11} & A_{1M} \\ A_{N1} & A_{NM} \end{pmatrix} \quad B=\begin{pmatrix} B_{11} & B_{1M} \\ B_{N1} & B_{NM} \end{pmatrix}$$

A and B: term-by-term product.
Equivalent to the term-by-term logical product
For network graphs $$A\&B=\begin{pmatrix} A_{11}.B_{11} & A_{1M}.B_{1M} \\ A_{N1}.B_{N1} & A_{NM}.B_{NM} \end{pmatrix}$$

DEFINITION OF THE GENERALIZED CHANNEL MATRIX

Channel matrix $$H(\tau)_{Tx_1,\ldots,Tx_M \to Rx_1,\ldots,Rx_N} = \begin{pmatrix} H_{11}(\tau) & H_{1M}(\tau) \\ H_{N1}(\tau) & H_{NM}(\tau) \end{pmatrix}$$

Network (macro)graph $$G'(\tau)_{Tx_1,\ldots,Tx_M \to Rx_1,\ldots,Rx_N} = \begin{pmatrix} G'_{11}(\tau) & G'_{1M}(\tau) \\ G'_{N1}(\tau) & G'_{NM}(\tau) \end{pmatrix}$$

Generalized channel $$H'(\tau)_{Tx_1,\ldots,Tx_M \to Rx_1,\ldots,Rx_N} = \begin{pmatrix} G'_{11}(\tau)\ \&\ H_{11}(\tau) & G'_{1M}(\tau)\ \&\ H_{1M}(\tau) \\ G'_{N1}(\tau)\ \&\ H_{N1}(\tau) & G'_{NM}(\tau)\ \&\ H_{NM}(\tau) \end{pmatrix} = [G'] \& [H'(\tau)]$$

FIG.4

METHOD FOR JAMMING COMMUNICATIONS IN AN OPEN-LOOP-CONTROLLED NETWORK

CROSS-REFERENCE TO RELATED APPLICATION

This application claims priority to foreign French patent application No. FR 1203479, filed on Dec. 19, 2012, the disclosure of which is incorporated by reference in its entirety.

FIELD OF THE INVENTION

The invention relates to a method of jamming with optimization of the effectiveness and limitation by open-loop control of the fratricidal effects on telecommunications posts associated with a communications network to be safeguarded.

The method according to the invention applies, for example, for jamming certain chosen communication links between entities external to the network to be safeguarded while preserving the communications links in the communications network.

BACKGROUND

The joint use by one and the same force of transmission networks and of jammers (or of networks of jammers) in a theatre of operations in the broad sense, and particularly in terrestrial convoys, in flights of aircraft and in squadrons of ships, is often greatly penalized by the absence of precise control of the effects induced by the jammer or jammers on the transmission post or posts of the network or networks of the force.

The technical problem to be solved for the jointly used transmission networks and the jammers is to limit the fratricidal effects of the jammers on the transmission posts, while guaranteeing a minimum of effectiveness of the jamming on the targets or on the sectors of interest of the theatre.

A first optimization method described in the applicant's patent application FR 11 03578 relies on setting up closed-loop centralized control. This method addresses the problem by resorting to a master station for the jammers, this possibly not being appropriate for all technico-operational situations. A need currently exists for a method that solves the technical problem in open-loop, implementing decentralized decisions at the level of each transmitting and receiving station.

DEFINITIONS

Jammer: transmission system capable of transmitting a signal intended to prevent the operation of all or some of the equipment using the electromagnetic spectrum (transmission posts, radar or navigation systems present in the theatre of operations). A jammer is designated in the subsequent description by the letters Br, the jamming signal by b, the jamming signal vector by B.

Network of jammers: coordinated set of transmission systems which are adapted for transmitting signals intended to prevent the operation of all or some of the equipment using the electromagnetic spectrum present in the theatre of operations.

"Friendly" transmission post or "friendly post": transmission post defined as forming part of the communications system to be safeguarded and having to be protected from the effects of jamming.

"Friendly" transmission network or "friendly network": interconnectable set of "friendly" transmission posts.

Friendly transmission: transmission originating from a friendly post or from a friendly jammer.

"Target" equipment: equipment defined as having to be affected by the jamming.

Communicating jammer: jammer furnished with a "friendly" transmission post.

Network of communicating jammers: network of jammers furnished with "friendly" transmission posts, constituting a friendly transmissions sub-network.

Jamming of target equipment: Transmission of a signal or of several signals, from a jammer or from a network of jammers, in such a way that the target equipment is prevented from implementing or from maintaining its service.

Jamming of a geographical zone: Transmission of a signal or of several signals, from a jammer or from a network of jammers, in such a way that any target equipment present in the geographical zone is prevented from implementing or from maintaining its service.

Detection of a signal: capability to decide the presence of a friendly transmission or one originating from an external entity and to intercept the signal. This detection is performed in the band and the duration of analysis of one or more interceptors, analysis module or detection or "sensing" function which may be, for example, hosted by the friendly transmission posts or in direct connection with the friendly posts.

Detection of a transmitter: capability to decide the presence of a transmitter in the theatre by detecting the signal or signals that it transmits.

Location of a transmitter: capability to decide the site of a transmitter in the theatre by detecting the signal or the signals that it transmits.

SISO: single input single output: said of a system of transmissions with one transmitting pathway Tx, one receiving pathway Rx.

SIMO: single input multiple output: said of a system of transmissions with one pathway Tx, N pathways Rx.

MISO: Multiple Input, Single Output: said of a system of transmissions with M pathways Tx, one pathway Rx.

MIMO: Multiple Input, Multiple Output: said of a system of transmissions with M pathways Tx, N pathways Rx.

CIR: Channel Impulse Response: said of the impulse response of the transmission channel, considered to be a finite-response filter.

The term matrix designates a channel matrix.

The domain of jamming has formed the subject of numerous studies and inventions. However, fratricidal effects are always treated fairly poorly in developments known to date. In general, the constraints associated with the implementation of the methods and systems known to the applicant have the effect notably of drastically limiting the ranges and the number of simultaneous friendly radiocommunications, or indeed even of preventing the use of friendly radiocommunications.

SUMMARY OF THE INVENTION

The subject of the present invention relates, notably, to a method which will make it possible to effectively limit the fratricidal effects with a flexibility and a range sufficient to simultaneously allow the jamming of the targets or zones to be jammed and the functioning of the communications between friendly posts in an operational context.

The invention can be implemented on friendly posts employing multiple waveforms on condition that:

the jammers follow frequency plans, temporal patterns and waveforms known to the friendly transmitters/receivers, or readily recognizable to in-situ analysis from among a set known in advance, the friendly transmitters implement signal sequences detailed in the subsequent description, the friendly receivers can carry out the measurements on the jamming signals and the friendly signals so as to formulate a local jamming situation and a local reception situation, and to decide the best transmission/reception strategy for the current communication links or those currently being established.

The invention relates to a method for minimizing in an adaptive and decentralized manner the fratricidal effects induced by the jamming of P predefined zones ZB or positions in a communications network comprising friendly transmitters, jammers and friendly receivers, the said network comprising N_pl platforms, a number M≤N_pl of the said platforms, termed friendly transmission platforms being equipped with antennas and with systems for transmitting useful transmission signals configurable in a dynamic manner, a number N≤N_pl of the said platforms, also termed friendly, being equipped with dynamically configurable antennas and systems for receiving useful transmission signals, a number J≤N_pl of the said platforms being equipped with jamming systems and antennas having characteristics known to the friendly transmission and reception platforms, the said jamming systems and antennas being adapted for preventing the transmissions between entities external to the said network of friendly platforms, the said platforms constituting a network, characterized in that it comprises at least the following steps:

$E_0$: Establishing a local reception situation: at the level of each of the N friendly reception platforms measuring, $E_1$, the friendly communication signals Su received by the said platforms originating from the M friendly transmitters, on the basis of the said measurements, for each of the N friendly reception platforms, estimating, $E_2$, the M useful levels received and the M useful propagation channels, N*M estimates, $E_3$: Establishing a local jamming situation: at the level of each of the N friendly reception platforms measuring, $E_4$, the jamming signals received by the said friendly reception platforms originating from the J jammers, on the basis of the measurements of the jamming signals, for each of the N friendly reception platforms, estimating, $E_5$, the J fratricidal jamming levels received and the J fratricidal jamming channels, N*J estimates in all, ascertaining a priori the waveforms of the jamming signals and the associated parametrizations, on the basis of the states of the local situations of jamming established by each of the N receiving platforms on the J signals originating from the J jammers, on the basis of the local reception situation established by each of the N receiving platforms on the useful communication signals Su; determining for each of the M friendly transmitting platforms and for each of the N friendly receiving platforms, at least one of the following configuration parameters: a frequency plan, and/or temporal positionings of the transmissions, antenna diagrams and/or orientations, radio access schemes and modulation/coding schemes for the signals transmitted and received, the parameter or parameters being adapted for minimizing or eliminating the fratricidal effects on the N friendly reception platforms, using the said configuration parameters in transmission and/or reception for the M friendly transmission platforms and the N friendly reception platforms.

After having defined a first set of configuration parameters for the M friendly platforms and for the N friendly platforms, the method will repeat steps $E_0$ to $E_5$ over time so as to maintain and to optimize the configuration parameters for the platforms.

The method uses, for example, the measurement of the propagation channels originating from the J jamming platforms, to recognize in situ a predefined and known jamming strategy so as to jointly optimize the transmission and the quality of the transmissions useful at the level of the friendly transmitting and receiving platforms by adapting the transmission power levels and/or the frequency plans and/or the temporal positioning of the transmissions and/or the spatio-temporal coding schemes and/or the radioelectric resource access protocols employed by the friendly transmitters and receivers.

The method can use jamming signals which code, in a manner known to the friendly receivers, the information useful to the friendly transmitters and receivers so as to inform the latter of the jamming strategy employed, of the characteristics of the jamming waveforms and associated parameters, transmission power, type of diagram and orientation of the antennas, position, altitude, to facilitate the joint optimization of the transmissions and reception processings of the transmissions useful at the level of the friendly transmitting and receiving platforms, the said coded information being reconstructed by the analysis of the jamming signals received by the friendly receivers or being decoded in the jamming signals received by the friendly receivers.

According to a variant embodiment, the method uses, for example, friendly programmable transmitters and receivers adapted for taking dynamic account of the transmission setpoints, regarding the power and/or regarding temporal parameters, the waveform, the spatio-temporal codings, the amplitude phase weighting of the antenna elements.

The method can be used in transmission networks using the MIMO, MISO, SIMO or SISO protocols with or without return pathway from the friendly receivers to the friendly transmitters.

The method can also be used in a radio network comprising receivers adapted for measuring values of transmission channels on the useful transmitters and on the jammers.

According to another variant, the method can be used in a radio network comprising one or more reception posts comprising antennal elements coupled to an interceptor which is adapted for performing transmission channel measurements on the useful transmitters and on the jammers.

The method exploits decentralized decision specific to each friendly transmitter friendly receiver link. It utilizes notably the capabilities of measurements of environment at work in modern modems (SISO, MISO, SIMO and MIMO according to case). It also utilizes the a priori knowledge, by the friendly transmitter receiver posts, of the frequency plans, jamming patterns and waveforms, thereby rendering them readily recognizable by the friendly posts with a minimum of analysis, undertaken at the same time as the CIR measurements and as the informed equalization methods specific to modern modems. Moreover, the frequency plans, temporal patterns and coding modulation schemes specific to the friendly links can likewise be predefined in advance with a reduced set of parameters, and adapted on the fly to the radioelectric situation, according to the frequency occupancy of the channels, the temporal patterns and the jamming waveforms. The analysis needs in the friendly transmitters/receivers are then reduced and the decision taking regarding the adaptation of the friendly communication signals is thereby simplified.

BRIEF DESCRIPTION OF THE DRAWINGS

Other characteristics and advantages of the present invention will become more apparent on reading the description given by way of wholly nonlimiting illustration, accompanied by the figures which represent:

FIG. 2, a formal example of model of generalized propagation channel in the MIMO case, with definitions and notations of the pertinent geometric and physical quantities, FIGS. 3A, 3B, an illustration of the notions of network graph and of macrograph which are used to describe the links between friendly posts (Tx, Rx), the interactions between jammers Br and external entities to be jammed, FIG. 4, a logical product between network graph and channel matrix, defining a generalized channel matrix which takes account at one and the same time of the links or interactions between the parties, transmitters receivers, jammers, zones or points to be jammed, and of the propagation channels between these parties.

DETAILED DESCRIPTION

Figure 1:
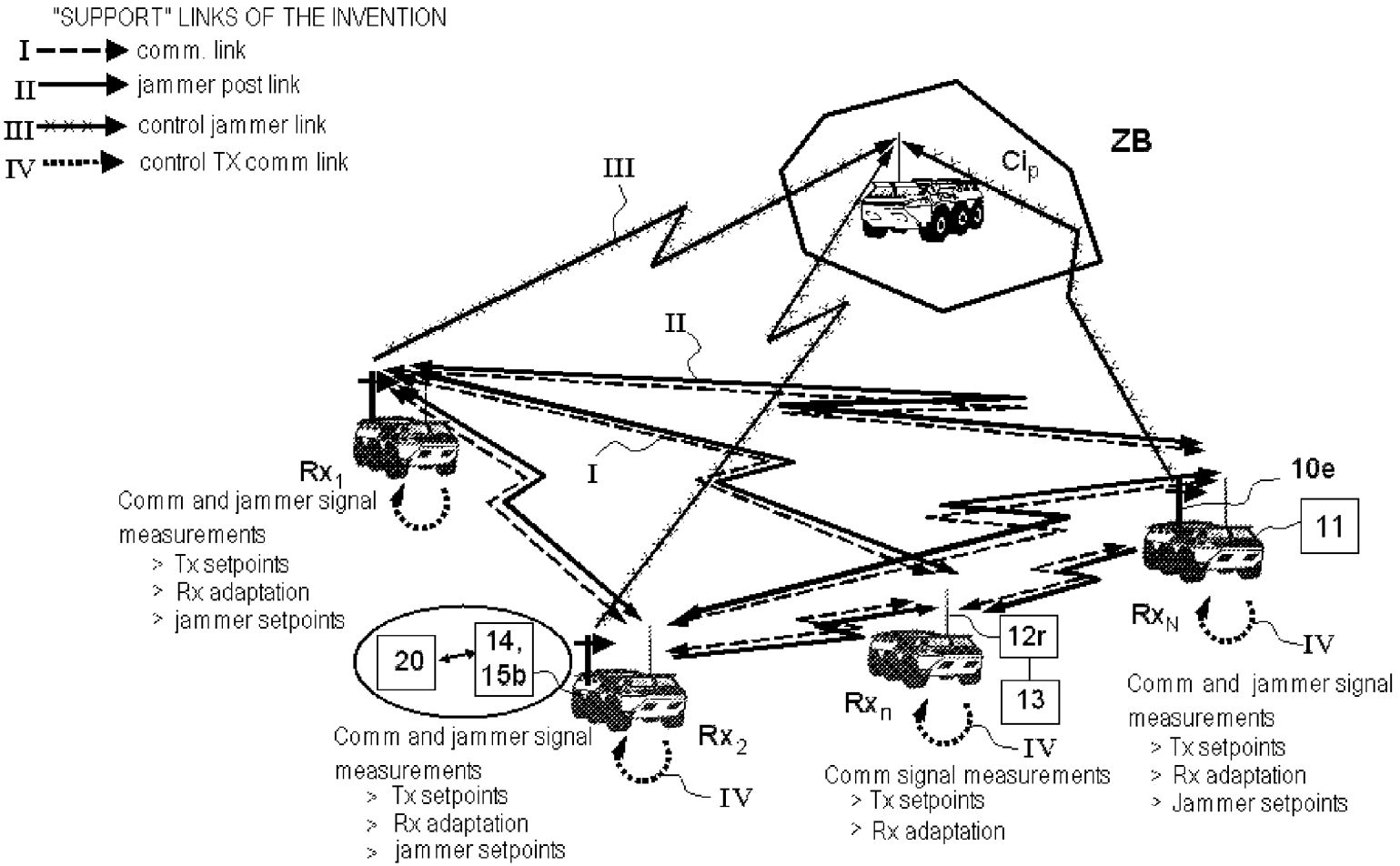
FIG. 1, an exemplary architecture of the system according to the invention.

The example which follows is given by way of wholly nonlimiting illustration for a communication system comprising N_pl transmission platforms which have MIMO, MISO, SIMO or SISO communication posts.

FIG. 1 shows diagrammatically an exemplary network architecture in which the method according to the invention can be implemented.

One or more reception stations $Rx_1$, $Rx_2$, . . . , $Rx_N$ are in point-to-point or point-to-multipoint link by RF communication pathway for example with M=N_pl−1≤N_pl friendly transmitter/receiver platforms or posts 10, that is to say posts equipped with a transmitting part Tx and with a receiving part Rx. The M friendly platforms are equipped with dynamically configurable antennas 10*e* and with systems 11 for transmitting useful transmission signals.

The network comprises a number N≤N_pl of the said platforms, also termed friendly, being equipped with dynamically configurable antennas 12*r* and with systems 13 for receiving useful transmission signals.

From among these N_pl platforms, a number J≤N_pl "jammer" platforms $B_{r1}$, . . . $B_{rJ}$ have system 14 and a jamming antenna 15*b*, of omnidirectional type, of directional type or of network type. The transmission characteristics of the systems and antennas are known to the friendly platforms. The transmission characteristics are notably chosen so as to prevent the transmissions between entities external to the said network of friendly platforms, the said platforms constituting an inter-platform network.

The friendly platforms (jammers or without jammer) therefore define an inter-platform communications network which appears, if the set of antennal elements is considered, as a macro-network. Also represented in FIG. 1 is a zone to be jammed ZB in which radio equipment external to the network of friendly posts may be situated. Each reception station $Rx_1$ to $Rx_N$ receives from the M transmitter posts $T_{x1}$ . . . $T_{xM}$, friendly useful communication signals. A station performs measurements of signal level received Nsr and of channel impulse responses. Each station also receives from the jammers $B_{r1}$, . . . $B_{rJ}$, jamming signals Sb regarding which it is informed (that is to say it knows the main characteristics thereof a priori) and can also conduct measurements of jamming signal level received Nbr and of channel impulse responses.

Each station is equipped with a device adapted for managing, at each instant, the communication links with the other stations, the device being for example a decision and decentralized local control facility 20 specific to each friendly transmitter/receiver link.

The decision facilities correspond, for example, to the MAC access layer of a terminal or of a master post. A post comprises a processing device receiving the information on the friendly signal, jamming signal, the values of the associated channels and which is adapted for deducing therefrom the values of the transmission/reception parameters which make it possible not to disturb the links between friends.

The communication links are represented in FIG. 1 in the following manner:

I: conventional common link including the set of measurements performed on the communications links or "reporting" (measurements performed by the friendly posts or by friendly interceptors in favour of the friendly posts on the sequences of signals transmitted by the friendly transmitters Tx) retransmitted if appropriate by return pathway to the friendly posts Tx, II: link comprising the "reporting" of the measurements on jammer signal, i.e. the set of measurements performed on the jammer signals (measurements performed by the friendly receivers or by interceptors in favour of the friendly receiver posts on the sequences of signals transmitted by the jammers Br, information retransmitted if appropriate by return pathway to the friendly posts Tx), III: link for control of the jammers on the basis of the information collected by the receivers or interceptors on the jammer platform (or in conjunction with the latter) and of the local decision facility, which are specific to the friendly Tx friendly Rx links, and IV: transmission of the jamming signals towards the zone aimed at ZB and/or towards the external entities Ci outside the friendly network.

The method implemented by the invention relies notably on:

- the recordings/measurements of the communication signals received by interceptors, dedicated analysis modules and environment appraisal function (or "sensing") which are for example co-located or integrated with at least one of the friendly posts,
- the recordings/measurements of the jamming signals interfering with the friendly posts, by interceptors, dedicated analysis modules and sensing function which are for example co-located or integrated with at least one of the friendly posts,
- a formal description of the interactions between friendly transmitter posts Tx, friendly receiver posts Rx, jammers Br and external entities to be jammed Ci, by graphs and macro-graphs which will be specified hereinafter,
- on a general model of propagation of the transmission channel, generalized to take account of the effective interactions between friendly transmitter and receiver posts (Tx Rx) (generally integrated together within a friendly transmission post), jammers Br and external entities Ci, through a notion of generalized channel matrix specified hereinafter,
- on the casting and then on the partial solving of a constrained optimization problem, specified hereinafter,
- jammers which are programmable and dynamically configurable in terms of waveform (envelope, modulation, amplitude, phase, etc.), and for which the frequency plans (choice of the bands, sub-bands and carriers of the jamming signal), the temporal transmission patterns (recurrence of the transmissions according to time and frequency) are known, of jamming waveforms, which are multiple and if appropriate complex, but known to the friendly receivers, sequences of digital signals Sb transmitted by the jammers, chosen and adapted to allow precise measurements in reception on the said jamming signals received by the posts or stations of the network, sequences of digital signals Su transmitted by the friendly transmitters, chosen so as to allow precise measurements in reception on the said friendly signals received by the posts or stations of the network, a formulation of the local jamming situation at the level of a post, according to the jamming power measurements received on the posts and of the associated transmission channels; the formulation is performed by the friendly posts, aided by the a priori knowledge by the friendly receivers of the frequency plans, temporal patterns and possible jamming waveforms, a formulation of the local reception situation at the level of a station, according to the precise measurements of received useful power originating from the friendly transmitters and associated transmission channels; the formulation is performed by the friendly posts, aided by the a priori knowledge by the friendly receivers of the frequency plans, temporal patterns and possible friendly waveforms, of frequency plans, transmission patterns and recurrences, parametrizable spatio-temporal coding and modulation schemes for the digital signals transmitted by the friendly transmitters, chosen and intended to allow them to dynamically adapt the transmission links to the jamming situation, at one and the same time by antenna processing (optimal dispositions and orientations of the antenna patterns in transmission and reception) and by time frequency processing (equalization, modulation and adaptive codings and bitrates, etc.), decentralized decision facilities, or indeed ones internal to the friendly posts, allowing the formulation of setpoints and transmission reception adaptive parametrizations which optimize the links between friendly posts, the said decisions being based on the formulation of the local jamming situations and on the formulation of the aforementioned local reception situations.

In the subsequent description, the channels are determined as consisting of the set of RF propagations between each of the transmitters (jammer or friendly communication transmitter) and each of the friendly communication receivers or each of the targets or zones to be jammed Ci (the zones to be jammed being discretized in the forms of lists of points to be jammed).

The channel matrix is the matrix of the combinations of RF propagation channels between the transmitters and the receivers (Tx Rx channel matrix), between the jammers and the receivers (Br Rx channel matrix) or between the jammers and each of the points to be jammed (Br, Ci channel matrix). These matrices are considered in a first global approach between the platforms (and not between the antennal elements present on each platform) and the value $a_{m,n}$ of an element of the channel matrix therefore describes physically and globally the RF channel between platform m and platform n. In the case where a friendly receiver comes into play, the matrix is filled in on the basis of the measurements performed on the useful signals and on the jammer signals. In the case where a zone or a point to be jammed $C_i$ comes into play, the matrix is filled in on the basis of a model of propagation between a jammer Br and the target $C_i$. All these matrices are thereafter considered in a second approach between each transmission antennal element (each platform may be furnished with several transmission antennas, for example jamming antenna and transmission antenna, themselves consisting of arrays of antennal elements) and each reception antennal element (each platform may be furnished with several reception antennas, themselves consisting of arrays of antennal elements). For each of the approaches, the first level of description of this matrix is binary $a_{m,n}=1$ if the platform (respectively the antenna) n, receives a signal from the platform (respectively the antenna) m, a finer level in the second approach in particular, corresponds to considering $a_{m,n}$ as the impulse response of the channel m,n, (if appropriate matrix-like) thereby completely characterizing a multiple input multiple output or MIMO, multiple input single output or MISO, single input multiple output or SIMO, or single input single output or SISO linear channel. This impulse response can be estimated in accordance with the measurements performed by the friendly receivers Rx on the sequences of signals and jammers, by models of propagation considered between transmitters or jammers and receivers, and in accordance with the models of propagation considered between jammers or transmitters and target or zone to be jammed.

The knowledge of the positions of the stations is useful for the optimization of the operation of the communication network and used for the optimization of the jamming. A synchronism or a precise date-stamping of the measurements is also useful for better global optimization.

The precise knowledge of the signal sequences contained in the jamming signals Sb and in the useful communication signals Su is used for the measurement of the signal reception levels and the measurement of the corresponding propagation channels by the friendly receivers Rx, and contributes to the global optimization of the method.

The graph-based representations exhibit the advantage of offering a synthetic representation of the set of interactions between the parties. For example, it is possible to represent the platforms or the antennas by placing an arc between two platforms or antennas if the signal transmitted by one is received by the other, and therefore if it has been possible to measure the channel.

Example given in respect of the implementation of the method according to the invention MIMO, MISO, SIMO, SISO "useful" communication posts are available on platforms in number N_Pl, of which J platforms comprise jammers.

"Networks of Transmitters and Receivers for the Useful Transmissions"

N_pl communication platforms are therefore available. Each of these platforms is MIMO, MISO, SIMO or SISO. The number of transmitting antennal elements of each of the these platforms is denoted $M_1, M_2 \ldots, M_{N_pl}$. The number of receiving antennal elements of each of the these N platforms is denoted $N_1, N_2 \ldots, N_{N_pl}$.

The network consisting of the $\Sigma_{M_pl}=\Sigma_{m=1 \ldots N_pl} M_m$ transmitter antennal elements Tx or Br and of the $\Sigma_{N_pl}=\Sigma_{n=1 \ldots N_pl} N_n$ antennal elements Rx appears as a macro-network, a priori greatly sparse. The set of communication platforms constitutes a network represented by the network graph of size N_pl such as defined above and denoted $G_0$. When the set of antennal elements is considered, a representation thereof by the macro-graph of size $\Sigma_{M_pl}\Sigma_{N_pl}$ is preferred, such as defined above and denoted $G_0'$.

The channel matrix of this macro network consisting of N_pl platforms and $\Sigma_{M_pl+N_pl}$ antennal elements can be written formally, as will be explained hereinafter or as may be seen in FIGS. 3A, 3B, 4, for which a generic notation is used, in the generalized form $H_0'(Tx,Rx)=G_0'\propto [H_0^{(A)}(Tx,Rx), H_0^{(R)}(Rx,Tx)]$. It is determined by the topology of the network (which determines $G_0$ and $G_0'$) and the channel matrices $H_0^{(A)}$ and $H_0^{(R)}$ specific to each link $Tx_m \rightarrow Rx_n$.

In the method implemented, termed "open-loop" according to the invention, the transmitters, receivers and communication nodes of the friendly network manage at each instant t (sampling $t_k$, k=1, 2, . . . ), the communication links and the pertinent parametrizations (protocols, bitrates, coding schemes and modulation, if appropriate, the weighting of the antenna networks in transmissions/reception, use of relays, etc.), by adapting to the radioelectric environment and to the possible jamming residuals, by being explicitly driven by a decentralized, local decision and control facility specific to each friendly Tx-Rx link. The jamming signals and levels themselves are not controlled on the basis of the friendly transmitters or of the receivers, but fixed as a function of independent effectiveness criteria specific to the geometry and to the targets to be jammed. The radioelectric situation and the interference level due to the jammings are measured by the friendly receiver on each link. The frequency plan, the temporal spatio-temporal parametrization of the radio access, the modulation and coding schemes, and the reception processings in the friendly posts are defined by the decentralized local control at the level of each post so as to optimize the useful link and to minimize the residual fratricidal effects related to the jammings, doing so by exploiting the available techniques known to the person skilled in the art on the friendly posts, if appropriate, for example: transposition of the useful communications on empty and/or little-jammed carriers in the frequency plan, "temporal positioning" or "slottage" of the communication on time intervals that are little jammed or left empty by jamming shapes themselves "slotted" or impulsive, antijammed pathway formation, interference reduction techniques and joint separation and demodulation techniques for friendly receivers having antennal networks and/or utilizing orthogonal codings in the useful signals transmitted, bitrate reduction and/or increase in the correcting power of the codings used (at the price of spectral effectiveness, of complexity of the reception processing, of consumption if appropriate), etc.

The set of antennal networks of the transmitters $Tx_1, \ldots, Tx_m$ ($M \leq N_pl$) and of the receivers $Rx_1, \ldots, Rx_N$ ($N \leq N_pl$) is therefore formalized as a macro-network $G_0'$ (defined by a matrix of size $(\Sigma_{M_pl}+\Sigma_{N_pl})^2$) whose links are completely described as in FIG. 4 by a generalized channel matrix which determines the complete generalized channel $H_0'(Tx,Rx,\tau)$. These matrices are determined by the topology of the network macro graph G' by the channel matrices specific to each link $Tx_m \rightarrow Rx_n$. The formal construction of these matrices is given in FIG. 4, the examples of FIGS. 3A and 3B, and of FIG. 2 illustrate the taking into account of the propagation channel to construct the channel matrices specific to each link $Tx_m \rightarrow Rx_n$. For the path $Tx_m \rightarrow Rx_n$, the formal expression for the useful signals originating from the transmitting platforms and received at the level of the receiving platforms is then at each instant t:

$$X(t) = (H_0' * S)(t)$$

i.e.

$$\begin{bmatrix} X_1(t) \\ X_N(t) \end{bmatrix} = \left[\begin{pmatrix} H'_{0_{11}} & H'_{0_{1M}} \\ H'_{0_{N1}} & H'_{0_{NM}} \end{pmatrix} * \begin{pmatrix} S_1 \\ S_M \end{pmatrix}\right](t)$$

where

N is the exact number of receiving platforms comprising a reception antenna ($N \leq N_pl$), M is the exact number of transmitting platforms comprising a transmission antenna intended for the transmissions of useful signals ($M \leq N_pl$), $H_0'$ is the "transmitters towards receivers" generalized channel matrix, $X_n(t)$ n=1, . . . , N is the vector of the useful signals received on the network of the antenna elements of the receiving platform of index n, $S_m(t)$ n=1, . . . , M is the vector of the signals transmitted on the network of the antenna elements of the transmitting platform of index m, of band B.

In FIG. 2 is also represented an exemplary geometry of the propagation in an axis X (East), Y (North).

The link between the element of index m of the network of transmitting platforms and the element of index n of the network of receiving platforms is characterized by:

$S_m(t)$ aforementioned, $X_{nm}(t)$, the contribution vector of the signal Sm received on element n of the antennal network in reception, $X_n(t)$ aforementioned, total signal vector received on sensor n of the network, $L_{mn}$ the number of paths of the propagation channel, I the index of the I-th multi-path, $\alpha^{(m,n)}I$ the attenuation of path I with respect to the mean losses, $\gamma^{(m,n)}I$, the mean direction of arrival of path I, $\tau^{(m,n)}I$, the mean delay of path L, the delays are contained in an interval $[O, T^{(m,n)}]$ dependent on the channel; urban, mountainous, etc.

$N^{(m,n)}$, is the number of sub-paths associated with path I, which sub-paths are assumed to be indiscernible for the signal of band B and therefore distributed in an interval of duration $T^{(m,n)} \ll 1/B$, $n_I$ is the index of sub-path I, $\phi^{(m,n)}{}_{nI,I}$ is the phase of the sub-path of indices I and $n_I$, $\alpha^{(m,n)}{}_{nI,I}$ is the relative level of the sub-path of indices I and $n_I$, $\theta^{(m,n)}{}_{nI,I}$ is the direction of arrival of the sub-path of indices I and $n_I$, $U_s(\theta^{(m,n)}{}_{nI,I})$ is the direction vector corresponding to the sub-path of indices I and $n_I$ for the signal source s.

The temporal distribution of the paths determines its type of fading (flat or selective depending on whether $T^{(m,n)} \leq \geq 1/B$) and its temporal coherence. The temporal distribution of the sub-paths determines its type of fading (flat or selective, depending on whether $T^{(m,n)}{}_I \geq 1/B$) and its temporal coherence. The amplitude distribution of the paths (respectively sub-paths) determines its statistical type (Rayleigh or Rice).

The angular distribution of the paths (respectively sub-paths) determines its angular coherence (omni-directional diffusion, diffusion cone).

"Parametrizations and Powers of the Useful Signals According to the Reception Processing":

$Data_m$ represents the useful signal to be transmitted from the transmitter $Tx_m$ to the receiver $Rx_n$. $S_m$ represents the signal or a signal vector at the output of the friendly transmitter $Tx_m$, by the linear transformation $S_m = Coding_m.Data_m$ which models in all generality a spatio-temporal coding scheme in transmission such as employed in SISO, SIMO, MISO or MIMO transmissions, the operator $Coding_m$ representing the spatio-temporal coding applied by the transmitter $Tx_m$ to the signal of useful data $Data_m$ at the input of the said transmitter. The set of possible values for the coding schemes, $Coding_m$, is denoted Dom_Coding.

In all cases, the spatio-temporal operator $Coding_m$ can be defined in a vector space of linear operators operating from a vector space of finite dimension (the space of the sampled useful signals of finite spatial dimension taken over a finite temporal horizon and) in an image vector space of finite dimension (the space of the spatio-temporally coded sampled signals, likewise of finite spatial dimension and of finite temporal horizon), and Dom_Coding can be taken as the unit sphere of the said vector space.

The power of the signal $S_m$ is denoted $\pi_{Sm}$.

It is possible to express $\pi_{sm}$ in the form $\pi_{Sm}=.S_m^H.S_m$.

$X_{m,n}=H_0'_{m,n}.S_m$ represents the input signal or signal vector of a friendly receiver $Rx_n$ after propagation in the filter $H_{m,n}$.

The power of the signal $X_{mn}$ is denoted $\pi_{Xmn}$.

It is possible to express $\pi_{Xmn}$ in the form $\pi_{Xmn}=X_{mn}^H.X_{mn}$.

$T_n$ represents the set of processings and filterings applied to the input signal $X_n$ to produce the processing output signal represented formally by $Y_{mn}=T_n(X_{m,n})$;

$T_n$ models in all generality a spatio-temporal decoding scheme in reception such as employed in SISO, SIMO, MISO or MIMO transmissions.

The set of possible values for the reception processings $T_n$ is denoted Dom_T.

In all cases, the spatio-temporal operator $T_n$ can be defined in a linear vector space of operators operating from a vector space of finite dimension (the space of the signals sampled at reception antenna input, taken over a finite temporal horizon) with value in an image vector space of finite dimension (the space of the spatio-temporally decoded sampled signals), and Dom_T can be taken as the unit sphere of the said vector space.

The power of the signal $Y_{mn}$ is denoted $\pi_{Ymn}$.

If $T_n$ is purely linear, it is possible to express $\pi_{Ymn}$ as a function of the coding $Coding_m$ applied, as a function of the channel $H_0'_{m,n}$, and as a function of the reception processing applied $T_n$ in the form $$\begin{aligned}\pi_{Ymn}(\text{Coding}_m;\, H_{0'm,n};\, T_n) &= Y_{mn}^H.Y_{mn}\\ &= (T_n.H_{0'm,n}.\text{Coding}_m.\text{Data}_m)^H.T_n.H_{0'm,n}.\text{Coding}_m.\text{Data}_m\\ &= X_{mn}^H.T_n^H.T_n.X_{mn}.\\ &= \text{Data}_m^H.\text{Coding}_m^H.H_{0'm,n}.T_n^H.T_n.H_{0'm,n}.\text{Coding}_m.\text{Data}_m\end{aligned}$$

In this expression, only data transmitted $Data_m$ and the channel $H_0'_{m,n}$ evade the control of the local control facility, which can on the other hand control $Cadage_n$, and $T_n$ in the domains of the possible values Dom_Coding and Dom_T to optimize the useful link $Tx_m$ $Rx_n$.

At the level of each of the N friendly reception platforms, the method will establish, $E_0$, a local reception situation by measuring, $E_1$, the friendly communication signals Su received by the said platforms originating from the M friendly transmitters and then, on the basis of the said measurements, by estimating, $E_2$, for each of the N friendly reception platforms the M useful levels received and the M useful propagation channels (N*M estimates in all).

The useful signals and the procedures for measurements and for equalization of these signals in the receivers, notably on synchronization sequences or on pilot sequences, make it possible to estimate the M×N useful communications channels.

"Network of Jammers and Receivers"

J platforms from among the N_pl are furnished with "jammers" adapted for jamming the communications of the elements external to the friendly network; they are denoted $Br_1, \ldots, Br_J$. The set of jammers $Br_1, \ldots, Br_J$ and receivers and $Rx_1, \ldots, Rx_N$ constitutes a "jamming" network represented by an interference graph denoted GJ and submitted to a generalized propagation channel HJ'=GJ' & $H_J$(Br, Rx) defined according to the process described in FIG. 4, by considering the number of transmitting platforms J, the number of receiving platforms N and the J×N associated elementary channel matrices.

Each of the jammers $Br_j$, of index j, has an equivalent power level radiated in transmission (PIRE) defined by an interval [0, $PIREMAX_j$], fixed, but known to the friendly receivers for the implementation of the invention, with:

a power level setpoint $C_PIRE_j$, a jamming waveform $B_j$, known and measured in situ by the friendly receivers, one or more durations of jamming $Tb_j$ with the recurrences $Rb_i$ and an advance or a delay $\pi_j$ in transmission of the signal $B_j$ with respect to a common clock, these characteristics being known a priori and/or recognizable in situ by the friendly receivers during their measurement processes, one or more jamming frequency intervals denoted $Fb_j$ corresponding to the jamming intervals, known a priori and/or recognizable in situ by the friendly receivers during their measurement processes, weightings in amplitude $A_j$ and in phase $\phi_j$, if appropriate an antenna orientation $\Psi_j$ which can be regarded hereinafter as akin to a spatial weighting induced by the antenna directivity.

Enhanced jammers can also be used so as to code or tag in their jamming waveform the power levels PIREs, the jamming waveforms, the durations of the jamming signals, the recurrences with which these jamming signals occur, the delays, the frequencies, and the weightings $A_i$ $\phi_i$ $\psi_i$ that they apply to inform the friendly receivers thereof.

According to the foregoing, the set of antennal networks of the jammers $Br_1, \ldots, Br_J$ and of the antennal networks for reception of the receiving platforms $Rx_1, \ldots, Rx_N$ is formalized by two interference macro-networks defined by:

a macro-graph "network fratricidal jamming" denoted $G_J'$ integrating the transmissions of the jammers alone and the associated generalized channel matrix $H_J'$ (FIGS. 2, 3A, 3B).

The formal expression J(t) for the jammer signals received on a receiver network is then the following at any instant t:

$$J(t) = \left(H_J'^{(A)*}B\right)(t)$$

i.e.

$$\begin{bmatrix} J_1(t) \\ \\ J_N(t) \end{bmatrix} = \left[\begin{pmatrix} H'_{J_{11}} & H'_{J_{1J}} \\ \\ H'_{J_{N1}} & H'_{J_{NJ}} \end{pmatrix} * \begin{pmatrix} B_1 \\ \\ B_J \end{pmatrix}\right](t)$$

where

N is the exact number of receiving platforms comprising a reception antenna (N≤N_pl), J is the exact number of platforms comprising a jamming antenna (J≤N_pl), $H_J'^{()}$ is the "jammers towards receivers" generalized channel matrix, $J_n(t)$ n=1, . . . , N is the vector of jammer signals received on the network of antenna elements of the receiving platform of index n, $B_j(t)$ j=1, . . . , J is the vector of jamming signals transmitted on the network of antenna elements of the platform of index j.

"Parametrizations and Powers of the Jammer Signals According to the Reception Processing":

$B_j$ represents the jammer signal at the output of jammer $Br_J$.

$J_{jn}=H'_{J,j,n}.B_j$ represents the jammer signal for a transmission from jammer $Br_J$ to receiver $Rx_n$.

The power of the signal $J_{jn}$ at processing input is denoted $\pi_{Jjn}$.

It is possible to express $\pi_{Jjn}$ in the form $\pi_{Jjn}=X_{mn}^{H}.X_{mn}$.

After passing through the reception processing $T_n$ specific to receiver $Tx_n$, the jamming signal at input $J_{jn}$ is transformed into a jammer signal at output $J'_{jn}=T_n(J_{jn})$.

The power of the signal is denoted $\pi'_{J'jn}$. It is possible to express $\pi_{Ymn}$ as a function of the processing applied $T_n$ in the form $$\begin{aligned}\pi_{J'jn}(T_n;H_{J'j,n}) &= J'^{H}_{jn}.J'_{jn}.\\ &= (T_n.H_{J'j,n}.B_j)^{H}.(T_n.H_{J'j,n}.B_j)\\ &= J^{H}_{jn}.T^{H}_{n}.T_n.J_{jn}.\\ &= B^{H}_{j}.H^{H}_{J'j,n}.T^{H}_{n}.T_n.H_{J'j,n}.B_j)\end{aligned}$$

In this expression, the channel $H'_{Jj,n}$ and the jamming signal transmitted $B_j$ evade the control of the local control facility, which can on the other hand control $T_n$ in the domain of the possible values Dom_T to minimize the jamming level at output and optimize the useful link $Tx_m$ $Rx_n$. The domain Dom_T of the possible values of $T_n$ depends on the nature of the spatio-temporal processing applied.

"Target Zone or Target Receiver"

The J platforms $Br_1 \ldots Br_J$ are intended to jam one or more targets or zones characterized by a list of positions $Ci_1 \ldots Ci_P$ to be jammed. These positions are firstly geographical points, but may by extension be defined "in the broad sense" in the time/frequency/space domains:

in the temporal domain: the zone Ci can correspond to time slots to be jammed indexed on a pseudo-periodic frame which is known and/or controlled by the master station of the jammers, in the frequency domain: the zone Ci can correspond to jamming sub-bands to be jammed either in a continuous manner, or in a periodic manner (with indexation on a pseudo-periodic frame) which is known and/or controlled by the jammer or jammers, in the spatial domain: the zone Ci can correspond to the position of an identified target, to a geographical zone around this position, to a focusing towards this position. This makes it possible to consider a channel matrix $H_{BC}$ from the jammers to the target zones (which reduces in the case of a single jamming zone to a row vector 1×J), whose default values can be determined as a function of a geometric model or of an empirical model of isotropic mean attenuation dependent on the distance or any other parametric or empirical model (the target zone does not inform the jammers a priori of the effectiveness of the jamming . . . the jammer network can therefore only initiate its jamming strategy in accordance with a model, and only thereafter control if appropriate the effectiveness of the jamming—with a technique known by the acronym look-through for example).

The jamming signal being fixed and generated, analysis or sensing modules in the friendly receivers or interceptors which are associated therewith produce measurement results on the jammer signals by utilizing their a priori information of the waveforms and model or "pattern" of jamming so as to accelerate and augment the reliability of their measurement procedure, in such a way as to optimize their inherent links by adapting their spectral and temporal resource allocation plans and their se modulation coding scheme. The decision taking is local and decentralized at the level of each useful link, with no backlash on the parametrizations applied by the jammers, thereby inducing simplified management of the jammer network (advantage of the invention).

At the level of each of the N friendly reception platforms, $E_3$, a local jamming situation is established by measuring, $E_4$, the jamming signals received by the said friendly reception platforms originating from the J jammers, on the basis of the measurements of the jamming signals, for each of the N friendly reception platforms, the J fratricidal jamming levels received and the J fratricidal jamming channels, N*J estimates in all.

The jamming signals likewise integrating known sequences, procedures for measurements and for equalization of these signals are applied in the same manner on these signals in the interceptors, analysis modules or sensing function associated with the friendly receivers.

The results of the measurements are utilized by the receivers Rx of the friendly posts, optionally communicated to the friendly transmitters Tx, if the links have return pathways, so as to optimize the friendly Tx/friendly Rx useful links.

The network of jammers and the parametrizations which are applied to the jamming signals remain independent of the setpoints of optimizations specific to the useful links.

Knowing, a priori, the waveforms of the jamming signals and the associated parametrizations, on the basis of the local jamming situation states established by each receiving platform on the J signals originating from the J jammers, on the basis of the local reception situation states established by each receiving platform on the useful communication signals, the method calculates, for each of the M friendly transmitting platforms and each of the N friendly receiving platforms frequency plans, temporal positionings for the transmissions, antenna diagrams and/or orientations, radio access schemes and modulation/coding schemes for the signals transmitted and received eliminating or at the very least minimizing the fratricidal effects on the N friendly reception platforms. These first frequency plans, these temporal positionings, these antenna diagrams and/or orientations, these radio access schemes and these modulation/coding schemes are thereafter applied to the M friendly platforms in transmission and to the N friendly platforms in reception, so as to initialize the reduction in the fratricidal effects of the jamming.

According to one embodiment, the friendly receiving platforms continue in a continuous manner or in a recurrent manner the evaluation of the jamming situation local states and of the reception situation local states so as to continue the calculation of the frequency plans and the application of these frequency plans, temporal positionings of the transmissions, antenna diagrams and/or orientations, radio access schemes and modulation/coding schemes for the signals transmitted and received, so as to maintain and to optimize, by frame-by-frame iteration, the useful bitrate of the transmission service, the power and the quality of the transmissions and of the reception on the friendly platforms while maintaining or reducing the risk of acceptable fratricidal jamming for the quality of the useful transmissions.

Various alternative implementations of the invention can be devised according to the nature of the jammers used and the degree of information of the friendly posts on these jammers, and finally according to the onboard processing capability embedded in the friendly posts.

1/The method according to the invention can be implemented for jamming parameters and modes as follows:

- sectorial
- min/max/mean power
- spatio-temporal pattern.

2/In a variant of the method, setpoints can also be formulated and disseminated to the friendly transmitters.

3/The method can also be used for Spatio Temporal schemes implemented in the friendly transmitter posts from among the following:

- simple spatial redundancy between pathways Tx and temporal redundancy between the messages
- the ST scheme, robust at Rx to external interference (i.e. non Multi-Path)
- the use of one of the Tx antennas for the jamming signal on each MIMO or MISO Tx and of the other Tx antennas for the communication
- the formation of "spatial pathways" for jamming with a sub-network in transmission (sparse) of com/jammers "hybrid" MISO or MIMO Txs.

4/The method can also be used with friendly receiver posts equipped with Spatio Temporal filters chosen from among the following list, given by way of wholly nonlimiting illustration:

- Jammer Cancellation
- SIMO by Pathway Formation (PF) or by Spatial Matched Filtering (SMF)
- "Optimal" spatio-temporal matched filter in the presence of external interference(s)
- Rejector filter utilizing the a-priori known jammer waveform
- Rejector filter utilizing the a-priori known jammer direction (with or without prior goniometry of the jammer)
- etc.

The process for optimizing the useful links involves certain criteria related to the reduction in the fratricidal jammings and/or to the maximization of the ratio between the power of the useful signal and the power of the fratricidal jamming on each receiver $Rx_n$, which may be written in accordance with the foregoing in several forms, such as the following, introducing convex functionals:

- criteria pertaining to the minimization of the mean fratricidal signal level or mean fratricidal+interfering the receivers $Rx_n$ at processing output $T_n$ on the receiver $Rx_n$,
- criteria pertaining to the maximization of the ratio between the useful signal power at processing output and the power of the residual jamming signal at processing output on the receiver $Rx_n$.

Four criteria which can be applied are given hereinbelow by way of nonlimiting illustration, from the least complex to the most complex to implement.

Criterion of Threshold_max_JR Type:

For each friendly receiver $Rx_n$, this criterion guarantees a jamming level on the signals at processing output which does not exceed a given jamming threshold $\Delta Br_n$. For each friendly receiver $Rx_n$, the parameter sought is solely the reception processing operator of $Rx_n$ in its domain of value.

For all n=1, . . . , N, this therefore entails searching for a parameter $T_n$ in the domain Dom_T which satisfies the following thresholding criterion on the sum of the residual fratricidal contributions of the jammers:

$$JR_n = \sum_{j=1}^{J} \pi_{J'j,n}(H_{J'j,n};\, T_n) \leq \Delta Br_n$$

knowing that $$\begin{aligned}\pi_{J'jn}(T_n; H_{J'j,n}) &= tr[J'_{jn}.J'^{H}_{jn}]\\ &= tr[T_n.J_{jn}.J^{H}_{jn}.T^{H}_{n}]\\ &= tr[(T_n.H_{J'j,n}.B_j).(T_n.H_{J'j,n}.B_j)^{H}].\end{aligned}$$

and knowing that the parameters $H'_{J'j,n}$ and $B_j$ are not controlled for the optimization of the criterion but known by analysis and measurement and a priori information.

Criterion of Min_JR Type:

For each friendly receiver $Rx_n$, this criterion is aimed at seeking a minimum jamming level on the signals at processing output. For each friendly receiver $Rx_n$, the optimized parameter is solely the reception processing operator of $Rx_n$ in its domain of value.

For all n=1, . . . , N; this therefore entails searching for the reception processing $T_n$ which minimizes the sum of the residual fratricidal contributions of the jammers $$JR_n = \sum_{j=1}^{J} \pi_{J'j,n}(T_n;\, H_{J'j,n})$$

knowing that:

$$\begin{aligned}\pi_{J'jn}(T_n; H_{J'j,n}) &= tr[J'_{jn}.J'^{H}_{jn}]\\ &= tr[T_n.J_{jn}\cdot J^{H}_{jn}\cdot T^{H}_{n}]\\ &= tr[(T_n.H_{J'j,n}.B_j).(T_n.H_{J'j,n}.B_j)^{H}]\end{aligned}$$

knowing that the parameters $H'_{J'j,n}$ and $B_j$ are not controlled for the optimization of the criterion but only known by measurement, analysis and a priori information. This may be written formally for each receiver $Rx_n$:

$$\forall\, n = 1 \ldots N,\ T_n = \underset{t_n \in Dom_T}{\mathrm{Argmin}}\{JR_n\} = \underset{t_n \in Dom_T}{\mathrm{Argmin}}\left\{\sum_{j=1}^{J} \pi_{J'j,n}(H_{J'j,n};\, t_n)\right\}$$

Carrying out this criterion amounts to solving for all n=1, . . . , N; an optimization problem for the quadratic criterion $$\sum_{j=1}^{J} \pi_{J'j,n}(H_{J'j,n};\, t_n)$$

in the variable $t_n$, under the constraint $t_n \in$Dom_T.

Criterion of Threshold_min_SJR Type:

For each friendly transmitter $Tx_m$-friendly receiver $Rx_n$ link, this criterion is aimed at guaranteeing a power ratio between the useful signal at processing output and the jamming signal at processing output which exceeds a given threshold $\Delta SJR_n$ corresponding to an a priori reception quality. For each friendly transmitter $Tx_m$, friendly receiver $Rx_n$ link, the parameters sought are here the matrix for coding the data useful for the transmission of $Tx_m$, i.e. the parameter $Coding_m \in$Dom_Coding, the reception processing operator of $Rx_n$, i.e. $T_n \in$Dom_T.

For any friendly $Tx_m$, $Rx_n$ link m=1, . . . , M; n=1, . . . , N; this therefore entails searching for parameters $Coding_m$ and $T_n$ in the respective domains Dom_Coding and Dom_T which satisfy the following thresholding criterion on the useful signal to jammers ratio:

$$SJR_{m,n} = \frac{\pi_{Y_{m,n}}(\mathrm{Coding}_m;\, H_{0'm,n};\, T_n)}{\sum_{j=1}^{J} \pi_{J'j,n}(H_{J'j,n};\, T_n)} \geq \Delta SJR_n$$

knowing that $\pi_{Y_{mn}}(Coding_m, H0'_{m,n}, T_n)=tr[Y_{mn}.Y_{mn}^H]=tr[T_n.X_{mn}.X_{mn}^H.T_n^H]=tr[T_n.H0'_{m,n}.Coding_m.Data_m.(T_n.H0'_{m,n}.\ Coding_m.Data_m)^H]$, knowing that the channel parameter $H_0'_{m,n}$ is not controlled for the optimization of the criterion but known by analysis and measurement and a priori information, knowing that the useful data $Data_m$ are neither known nor controlled, knowing that $$\begin{aligned}\pi_{J'jn}(T_n; H_{J'j,n}) &= tr[J'_{jn}.J'^H_{jn}]\\ &= tr[T_n.J_{jn}.J^H_{jn}.T^H_n]\\ &= tr[(T_n.H_{J'j,n}.B_j).(T_n.H_{J'j,n}.B_j)^H]\end{aligned}$$

knowing that the parameters $H'_{J,j,n}$ and $B_j$ are not controlled for the optimization of the criterion but only known by measurement, analysis and a priori information.

Criterion of Max_SJR Type:

For each friendly transmitter $Tx_m$-friendly receiver $Rx_n$ link, this criterion is aimed at guaranteeing a maximum power ratio between the useful signal at processing output and the jamming signal at processing output corresponding to an optimal a priori reception quality for the radioelectric milieu surrounding the transmission $Tx_n \longleftrightarrow Rx_m$. For each friendly transmitter $Tx_m$, friendly receiver $Rx_n$ link, the parameters sought are here the matrix for coding the data useful for the transmission of $Tx_m$, i.e. the parameter $Coding_m \in$Dom_Coding, the reception processing operator of $Rx_n$, i.e. $T_n \in$Dom_T.

For any friendly $Tx_m$, $Rx_n$ link m=1, . . . , M; n=1, . . . , N; this therefore entails searching for parameters $Coding_m$ and $T_n$ which maximize the ratio between the power of the useful signal at processing output the sum of the residual fratricidal jamming contributions, i.e. which maximize the criterion $$SJR_{m,n} = \frac{\pi_{Y_{m,n}}(\mathrm{Coding}_m;\, H_{0'm,n};\, T_n)}{\sum_{j=1}^{J} \pi_{J'j,n}(H_{J'j,n};\, T_n)}$$

knowing that $\pi_{Y_{mn}}(Coding_m, H_0'_{m,n}, T_n)=tr[Y_{mn}.Y_{mn}^H]=tr[T_n.X_{mn}.X_{mn}^H.T_n^H]=tr[T_n.H_0'_{m,n}.Coding_m.Data_m.(T_n.H_0'_{m,n}.\ Coding_m.Data_m)^H]$, knowing that the channel parameter $H_0'_{m,n}$ is not controlled for the optimization of the criterion but known by analysis and measurement and a priori information, knowing that the useful data $Data_m$ are neither known nor controlled, knowing that $$\begin{aligned}\pi_{J'jn}(T_n; H_{J'j,n}) &= tr[J'_{jn}.J'^H_{jn}]\\ &= tr[T_n.J_{jn}.J^H_{jn}.T^H_n]\\ &= tr[(T_n.H_{J'j,n}.B_j).(T_n.H_{J'j,n}.B_j)^H]\end{aligned}$$

knowing that the parameters $H'_{J,j,n}$ and $B_j$ are not controlled for the optimization of the criterion but only known by measurement, analysis and a priori information. This may be written formally $$\forall\, m = 1 \ldots M;\, n = 1 \ldots N,$$

$$\begin{aligned}T_n &= \mathrm{ArgMax}\{SJR_{m,n}\}\\ &= \underset{\substack{t_n \in Dom_T\\ cod_m \in Dom_Codings}}{\mathrm{ArgMax}} \left\{ \frac{\pi_{Y_{m,n}}(cod_m;\, H_{0'm,n};\, t_n)}{\sum_{j=1}^{J} \pi_{J'j,n}(H_{J'j,n};\, t_n)} \right\}\end{aligned}$$

carrying out this criterion amounts to solving for all m=1, . . . , N and n=1, . . . , N an optimization problem for the criterion (quadratic in the coding variable $cod_m$)

$$SJR_{m,n} = \frac{\pi_{Y_{m,n}}(cod_m;\, H_{0'm,n};\, t_n)}{\sum_{j=1}^{J} \pi_{J'j,n}(H_{J'j,n};\, t_n)}$$

for the variables $cod_m$ and $t_n$, and under the constraints $cod_m \in$Dom_Coding and $t_n \in$Dom_T.

Example 1

Cooperative Barrage Jamming

This particular example of implementation of the invention applies to the optimization of tactical barrage jamming in the presence of frequency-evading friendly communication posts, which method has formed the subject of the Applicant's patent under the number EP 1303069.

It is shown hereinafter how the previously described general method of the invention is broken down for this particular application.

The barrage jammer or the network of barrage jammers has the capability to interrupt transmissions on certain time slots and certain frequency channels, by following certain pseudo random laws. This capability is a priori known to the friendly posts, as well as the main possible parametrizations which correspond to it, in particular the frequency plans and pseudo-random laws corresponding to the slots not occupied by the jamming signals.

P tactical posts present in the theatre are to be jammed denoted $Ci_p$, p=1, . . . , P. These posts are of known or unknown positions. The services that they use and the corresponding operating points are assumed known to the jammers as well as their characteristics (jamming/denial thresholds for the various services, operating margins etc.). The jammers adapt the parametrizations of their barrage jamming waveform.

N frequency-hopping friendly transmitters and receivers seek to safeguard to safeguard their communication links, denoted $R_n$ n=1, . . . , N.

These transmitters/receivers are of approximately known positions and under the control of local communications nodes dubbed LCNs (in a simplified implementation of the invention, the LCNs can be for example the friendly transmitters of each useful link, in a more elaborate implementation, the LCNs can be infrastructure components with local range, relays, "master" transmission posts dedicated to command, etc.)

The positions of the jammers, the positions of the friendly transmitters and of the receivers under its control and the panel of the usable waveforms and associated parametrizations are known to each LCN, local node controller. For example, the frequency-hopping laws, and if appropriate, the slot channels and transmission powers as well as the waveforms used can be chosen by the CLN, or indeed driven by means of a synchronization signal transmitted to the posts that it controls (slave posts). Moreover, the CLNs have associated analysis module or interception capabilities sensing functions which allow them to conduct measurements at one and the same time on the transmitters/receivers whose positions they know, on the useful signals whose transmissions they control/know and on the reception processings of the slave posts, but also on the jammer signals that they do not control but whose main possible characteristics they know and which they can retrieve by in situ measurement. Each LCN can therefore in accordance with its measurements and its a-priori information on the jamming waveforms and on the posts under its control:

- evaluate the risks of interferences induced by the jamming signals on the receivers that it controls (or on those which have to be safeguarded),
- search for the time slots and the frequency channels not occupied by the jamming signals,
- drive accordingly the transmissions of the posts under its control so as to make their transmissions coincide with the frequency channels and with the time slots not occupied by the jamming signals.

The process for applying the method according to the invention can be indexed frame-by-frame. The k-th frame will be denoted $t_k$. This then entails for a local controller node LCN at each frame:

- driving the EVF transmissions of the useful communications, on the time spans or time/frequency slots left empty by the jammers,
- controlling over time the position of the transmitters receivers of the useful links so as to guarantee (by managing certain power margins and certain temporal guard intervals) the non-collision of the useful signals with the jammer signals despite the different propagation times of the said signals,
- in the case of high-speed mobile posts, controlling over time the Doppler of the transmitters receivers of the useful links so as to guarantee (by managing certain power margins and certain frequency guard intervals) the non-collision of the bands of the useful signals with those of the jammer signals despite the different relative speeds of the transmitters of the said signals.

In numerous cases the times required to propagate ground-ground communication signals over a few tens of kilometers at the most are negligible compared with the durations of the useful notches. Likewise the Doppler shifts corresponding to slow platforms are negligible compared with the bands of the useful transmissions. The physical problem is simplified and therefore reduces to the determination of the instants of starting of the transmissions and of the channels corresponding to these transmissions by the local communications node (LCN). In more complex cases of long-range propagation from mobile platforms (communication on aircraft and on flyby satellites for example), the LCN must in addition take account of the relative propagation times and Doppler).

Direct Deterministic Solution of the Optimization Problem

If the local communication node LCN is ideal, is able or knows how to restore through its measurement, the slots and the frequency channels left free by the jammer(s) on the present and future frames and if it knows exactly the "slave" posts at risk of jamming and finally if it is able to place the slots of its "slave" posts exactly on the slots left free by the jammer(s) without spilling over onto the adjacent frequencies or onto the adjacent slots, the previous optimization problem simplifies to the form of a resources allocation problem. There is indeed no fratricidal impact of the jamming on the useful links provided that the LCN can impose the following setpoint on the slave posts at risk of jamming: for each frame $t_k$, distribute for the links under jamming the transmissions and receptions of the useful signals over the slots left free by the jammer; therefore allot the free slots and channels to the slave transmitters and receivers according to a priority management strategy, according to a latency management strategy or according to a random competing strategy of ALOHA type, or according to any strategy conventionally used in radio access technologies.

Note that in this implementation of the invention, the precise knowledge of the positions of the slave posts and jammers by the local communication node provides substance to more thorough optimizations while remaining very simple: for example the knowledge of the positions directivities and orientations of the jamming antennas and the knowledge of the position of the slave posts allows the LCN to restore through simple models (link budget) the risks of jamming of its slave posts, and to select a priori only the slave posts which are actually under threat of jamming in the aforementioned resource allocation strategy. The measurements performed by the LCN and uploaded if appropriate by the slave posts to the LCN via the return pathways of the friendly links serve only to reinforce the allocation strategy by confirming the absence of fratricidal jammings or their low levels on the allocated slots.

If this variant is pushed to the extreme, it is even possible to consider the implementation of the invention in a still more simplified framework with an LCN not carrying out any measurement and simply informed a priori of the channels and time slots left free of jamming; the said information originates for example from a law decided in advance and known to the jammer and the LCN, or else the said information being coded in the jamming signal itself and decoded by the LCN in its analysis of the jamming signal, or else the said information being obtained by decoding an item of information transmitted in a tagging or triggering signal associated with the jammer.

Case of Multiple Jammers with Defects+Taking into Account of Jamming Budgets Estimated by Use of the a Priori Information of the Measurements and of Propagation Models The examples and variants hereinabove of implementation of the invention extend directly to the taking into account of the imperfections of one or more jammers, powers and directivities in transmission of the said jammers, directivities in reception of the friendly receivers, attenuations and filters for propagating the jammers to the friendly receivers, as well as operating thresholds of the friendly receivers:

- Rise and fall times of the jamming signal inducing a lower duration of availability of the slot than the slot duration, thereby similarly reducing the transmission duration utilizable in the jamming slots left empty,
- Spectral overspill of the jamming signal onto part of the channels that are left empty, because of insufficient filtering of the spectrum of the jamming signals, thereby similarly reducing the useful transmission band in the channels left empty of jamming
- Link budgets between the jammers $Br_J$ and the useful receivers $R_n$ modelled by loss coefficients $L_{j,n}$ inducing a level at input $L_{j,n}P_j$ ($P_j$: radiated isotropic power equivalent to the transmission by the jammer of index j). These input levels can be estimated by the friendly receivers (at least the LCN, or indeed the slave receivers if appropriate) in accordance with the a priori knowledge (or in accordance with the recovery by analysis of the jamming signals) of the PIRE transmitted, in accordance with the knowledge of the respective positions and angular characteristics of the friendly transmitters of the friendly receivers and of the jammers, and in accordance with a simplified propagation model (sufficiently representative of the attenuation phenomena in the frequency bands concerned for the terrain topology concerned and for the distances involved). This information, when it relates to the jammers, originates for example from strategies known in advance to the friendly receivers (at least known to the LCN) whose implementation is readily recognizable on analysis of the jamming signals; or else this information being coded in the jamming signal itself and decoded by the LCN in its analysis of the jamming signal; or else this information being coded in a tagging signal associated with the jammer, for example according to the method described in the applicant's patent application FR 1203071.
- Operating threshold $\Delta JR_n$ relating to the friendly receiver $Rx_n$ (according to their transmission service), expressing a condition of the form $[\Sigma_j L_{j,n}P_j]<\Delta JR_n$, which condition has to be satisfied by the aggregated power of the nuisance $[\Sigma_j L_{j,n}P_j]$ induced by the fratricidal jammings as a whole, the said nuisance being evaluated in accordance with the power estimations $P_j$ specific to the transmission of each jammer and in accordance with the link budget $L_{j,n}$ estimated for each jammer $Br_j$—receiver $Rx_n$ link. The aforementioned condition expresses in a manner (here simplified but sufficient and effective in numerous cases of implementation of the invention) the receiving capability of the useful link $Tx_m$ $Rx_n$ under acceptable conditions of noise+jamming. It can be evaluated a priori fairly simply on the basis of the a priori knowledge of the jamming schemes or of their in situ recognition by analysis, and by a link budget model. It can be reinforced in situ by measurement of $Rx_n$ on the jamming signals.

The optimization problem is then solved in a very simplified manner by a resource re-allocation strategy, here conditional on the thresholding $\Delta JR_n$: the fratricidal effects on the friendly posts remain limited and insignificant provided that the LCN can impose the following setpoint on the slave posts at risk of jamming (i.e. for which we would have $[\Sigma_j L_{j,n}P_j]>\Delta SJR_n$ in the absence of re-allocation and in the presence of jamming signals corresponding to the evaluations of powers received $P_1 \ldots P_J$): for each frame $t_k$, reallocate the links at risk of jamming the transmissions and receptions of the useful signals on the slots left free by the jammer; therefore allot the free slots and channels to the slave transmitters and receivers at risk of jamming according to a priority management strategy, according to a latency management strategy or according to a random competing strategy of ALOHA type, or according to any strategy conventionally used in radio access techniques.

- Operating threshold $\Delta SJR_{m,n}$ relating to the useful links between friendly transmitter $Tx_m$ friendly receiver $Rx_n$ (according to their transmission service), expressing a condition of the form $\pi_{Ym,n}/[\Sigma_j L_{j,n}P_j]>\Delta SJR_n$, which condition has to be satisfied by the ratio between the measured useful power received $\pi_{Ym,n}$ and the aggregated power of the nuisance $[\Sigma_j L_{j,n}P_j]$ induced by the fratricidal jammings as a whole, the said nuisance being evaluated in accordance with the power estimations $P_j$ specific to the transmission of each jammer and in accordance with a link budget model $L_{j,n}$ estimated for each jammer $Br_j$—receiver $Rx_n$ link. The aforementioned condition expresses in a manner (here simplified but sufficient and effective in numerous cases of implementation of the invention) the capability for establishing and/or sustaining the useful link $Tx_m$ $Rx_n$ under acceptable conditions. It can be evaluated fairly simply on the basis of the a priori knowledge of the jamming schemes or of their in situ recognition by analysis, by a link budget model (if appropriate reinforced by in situ analysis measurement of $Rx_n$ on the jammer signals), and on the basis of the measurements of received level on the useful signal.

The optimization problem is solved here again in a very simplified manner by a resource re-allocation strategy, here conditional on the thresholding $\Delta SJR_n$: the fratricidal effects on the friendly posts remain limited and insignificant provided that the LCN can impose the following setpoint on the slave posts at risk of jamming (i.e. for which we would have $\pi_{Ym,n}/[\Sigma_j L_{j,n}P_j]<\Delta SJR_n$ in the absence of re-allocation and in the presence of jamming signals corresponding to the evaluations of powers received $P_1 \ldots P_J$): for each frame $t_k$, reallocate the links at risk of jamming the transmissions and receptions of the useful signals on the slots left free by the jammer; therefore allot the free slots and channels to the slave transmitters and receivers at risk of jamming according to a priority management strategy, according to a latency management strategy or according to a random competing strategy of ALOHA type, or according to any strategy conventionally used in radio access techniques.

The invention claimed is:

1. A method for minimizing in an adaptive and decentralized manner fratricidal effects induced by jamming of P predefined zones ZB or positions in a communications network comprising friendly transmitters, jammers and friendly receivers, said network comprising N_pl platforms, a number M≤N_pl of said platforms, being friendly transmission platforms equipped with antennas and with systems for transmitting useful transmission signals configurable in a dynamic manner, a number N≤N_pl of said platforms, also being friendly, and being equipped with dynamically configurable antennas and systems for receiving useful transmission signals, a number J≤N_pl of said platforms being equipped with jamming systems and antennas having characteristics known to the friendly transmission and reception platforms, said jamming systems and antennas being adapted for preventing the transmissions between entities external to said network of friendly platforms, said platforms constituting a network, comprising at least the following steps:

$E_0$: Establishing a local reception situation: at the level of each of the N friendly reception platforms measuring, $E_1$, the friendly communication signals Su received by the said platforms originating from M friendly transmitters, on the basis of said measurements, for each of N friendly reception platforms, estimating, $E_2$, M useful levels received and M useful propagation channels, N*M estimates, $E_3$: Establishing a local jamming situation: at the level of each of the N friendly reception platforms measuring, $E_4$, the jamming signals received by the said friendly reception platforms originating from the J jammers, on the basis of the measurements of the jamming signals, for each of the N friendly reception platforms, estimating, $E_5$, J fratricidal jamming levels received and J fratricidal jamming channels, N*J estimates in all, ascertaining a priori the waveforms of the jamming signals and the associated parametrizations, on the basis of the states of the local situations of jamming established by each of the N receiving platforms on the J signals originating from the J jammers, on the basis of a local reception situation established by each of the N receiving platforms on useful communication signals Su; determining for each of the M friendly transmitting platforms and for each of the N friendly receiving platforms, at least one of the following configuration parameters: a frequency plan, and/or temporal positionings of the transmissions, antenna diagrams and/or orientations, radio access schemes and modulation/coding schemes for the signals transmitted and received, the parameter or parameters being adapted for minimizing or eliminating the fratricidal effects on the N friendly reception platforms, using the said configuration parameters in transmission and/or reception for the M friendly transmission platforms and the N friendly reception platforms.

2. The method according to claim 1, wherein, after having defined a first set of configuration parameters for the M friendly platforms and for the N friendly platforms, steps $E_0$ to $E_5$ are repeated over time so as to maintain and optimize the configuration parameters for the platforms.

3. The method according to claim 2 wherein it uses programmable friendly transmitters and receivers adapted for taking dynamic account of transmission setpoints, regarding power and/or regarding temporal parameters, waveform, spatio-temporal codings, or amplitude phase weighting of the antenna elements.

4. The method according to claim 2, using jamming signals which code, in a manner known to the friendly receivers, the information useful to the friendly transmitters and receivers so as to inform a latter of the jamming strategy employed, of characteristics of jamming waveforms and associated parameters, transmission power, type of diagram and orientation of antennas, position, altitude, to facilitate joint optimization of transmissions and reception processings of transmissions useful at the level of the friendly transmitting and receiving platforms, said coded information being reconstructed by analysis of the jamming signals received by the friendly receivers or being decoded in the jamming signals received by the friendly receivers.

5. The method according to claim 1, using measurement of the propagation channels originating from the J jamming platforms to recognize in-situ a predefined and known jamming strategy so as to jointly optimize the transmission and the quality of the transmissions useful at the level of the friendly transmitting and receiving platforms by adapting transmission power levels and/or frequency plans and/or temporal positioning of transmissions and/or spatio-temporal coding schemes and/or radioelectric resource access protocols employed by the friendly transmitters and receivers.

6. The method according to claim 5 wherein it uses programmable friendly transmitters and receivers adapted for taking dynamic account of transmission setpoints, regarding power and/or regarding temporal parameters, waveform, spatio-temporal codings, or amplitude phase weighting of the antenna elements.

7. The method according to claim 1, using jamming signals which code, in a manner known to the friendly receivers, the information useful to the friendly transmitters and receivers so as to inform the latter of the jamming strategy employed, of the characteristics of the jamming waveforms and associated parameters, transmission power, type of diagram and orientation of the antennas, position, altitude, to facilitate the joint optimization of the transmissions and reception processings of the transmissions useful at the level of the friendly transmitting and receiving platforms, the said coded information being reconstructed by the analysis of the jamming signals received by the friendly receivers or being decoded in the jamming signals received by the friendly receivers.

8. The method according to claim 1 wherein it uses programmable friendly transmitters and receivers adapted for taking dynamic account of transmission setpoints, regarding power and/or regarding temporal parameters, waveform, spatio-temporal codings, or amplitude phase weighting of the antenna elements.

9. Use of the method according to claim 1 in transmission networks using the Multiple Input Multiple Output, Multiple Input single Output, Single Input Multiple Output, or Single Input Single Output protocols with or without return pathway from the friendly receivers to the friendly transmitters.

10. Use of the method according to claim 1 in a radio network comprising receivers adapted for measuring values of transmission channels on the useful transmitters and on the jammers.

11. Use of the method according to claim 1 in a radio network comprising one or more reception posts comprising antennal elements coupled to an interceptor which is adapted for performing transmission channel measurements on the useful transmitters and on the jammers.

* * * * *